US006467219B1

(12) United States Patent
Gardner

(10) Patent No.: US 6,467,219 B1
(45) Date of Patent: Oct. 22, 2002

(54) SHUTTER RAIL TO STILE JOINT

(75) Inventor: Larry S. Gardner, Hoover, AL (US)

(73) Assignee: Alabama Venetian Blind

( * ) Notice: Subject to any disclaimer, the term of this patent is extended or adjusted under 35 U.S.C. 154(b) by 0 days.

(21) Appl. No.: 09/841,711

(22) Filed: Apr. 24, 2001

(51) Int. Cl.[7] ..... E06B 7/08
(52) U.S. Cl. ..... 49/74.1
(58) Field of Search ..... 49/74.1, 501, 504; 52/473

(56) References Cited

U.S. PATENT DOCUMENTS 3,634,992 A * 1/1972 Hughes ..... 52/731
4,454,703 A * 6/1984 Sitzler et al. ..... 52/788
4,794,714 A * 1/1989 Weisgerber ..... 40/152
5,379,551 A 1/1995 Swapp
5,584,154 A * 12/1996 Koepke et al. ..... 52/456
5,775,041 A * 7/1998 Tull et al. ..... 52/455
5,894,706 A 4/1999 Herbst
6,101,776 A * 8/2000 Conley ..... 52/379

* cited by examiner

*Primary Examiner*—Jerry Redman
(74) *Attorney, Agent, or Firm*—Smith, Gambrell & Russell, LLP

(57) ABSTRACT

An improved shutter stile to rail joint that prevents cosmetic damage to the exterior edges of a shutter caused by the weeping of bonding agent. A bonding agent weeping conduit communicates excess bonding agent away from exterior edges of an assembled shutter, and improves the strength of the finished joint.

16 Claims, 5 Drawing Sheets

SHUTTER RAIL TO STILE JOINT

TECHNICAL FIELD

This invention relates to the field of extruded polyvinyl foam shutters. More particularly this invention relates to an improved joint for joining ends of the shutter stiles and rails.

BACKGROUND OF THE INVENTION

Traditionally, shutters have been made from wood; however, wooden shutters tend to wear out. Wood expands and contracts with the weather resulting in visible signs of wear and tear. As a result of this wear and tear, the dimensions of wooden shutters can change during storage, shipment, or use depending on the environmental conditions.

More recently shutters have been made of extruded polyvinyl materials which have excellent structural rigidity and which do not expand, contract, warp, or absorb liquids. Extruded polyvinyl is a good insulator, nonflammable, and resistant to wear and tear. Polyvinyl can be extruded into a variety of shapes in a process that generates little waste. Because of these properties, the measurements of polyvinyl foam shutters remain constant despite environmental conditions during storage, shipping or use of the shutters.

A wide variety of shutter assemblies are currently available on the market. The nonmoving components of these assemblies are generally joined with a liquid or gel bonding agent. Due to the design of the current rail and stile components the shutter assemblies in the art exhibit unsightly visual characteristics due to the bonding agent weeping from the joints of the rails and stiles. Since the bonding agents typically used with polyvinyl materials meld the plastic to form a stronger bond between the assembled components, the weeping bonding agent will mar the exposed surfaces that it contacts, even though excess seepage of the bonding agent may be wiped from the surfaces.

BRIEF SUMMARY OF THE INVENTION

The present invention addresses the problem in the industry by providing a bonding agent weeping conduit that directs excess bonding agent inwardly from the exposed ends of the joined stiles and rails thereby eliminating the unsightly blemishes on the finished products. An additional benefit of the invention is improved joint strength realized by the improved distribution of bonding agent within the joint.

DETAILED DESCRIPTION OF THE DRAWINGS

Figure 1:
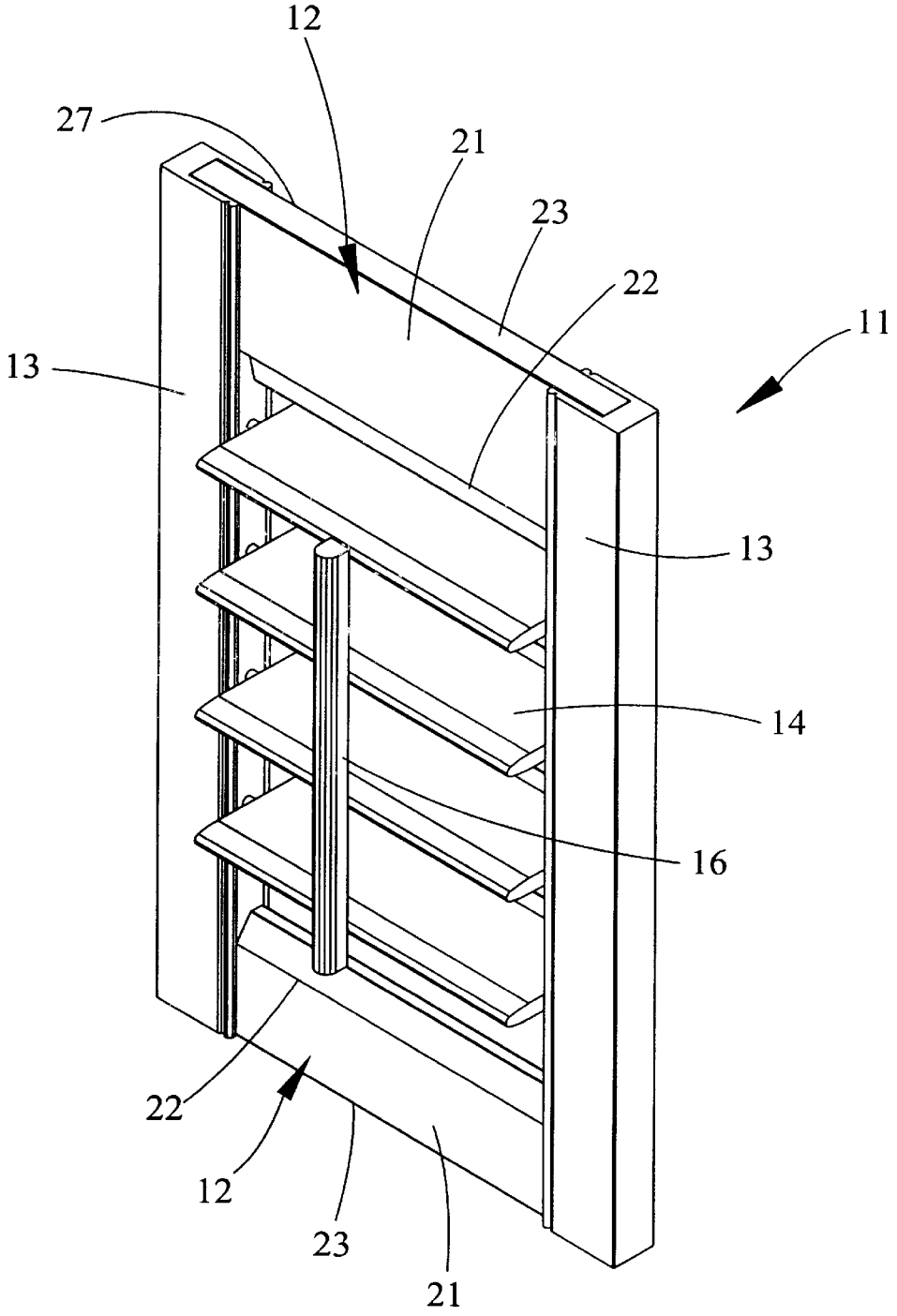
FIG. 1 is a perspective view of a shutter assembly.

Referring to the drawings for a better understanding of the invention a shutter assembly 11 is shown in FIG. 1. Shutter assembly 11 is comprised of a pair of opposed rails 12, a pair of opposed stiles 13, a plurality of louvers 14 pivotally disposed between opposed stiles 13, and an actuator rod 16 interconnecting louvers 14 for pivotally manipulating louvers 14 in unison. A bonding agent joins the rails 12 and stiles 13.

Figure 2:
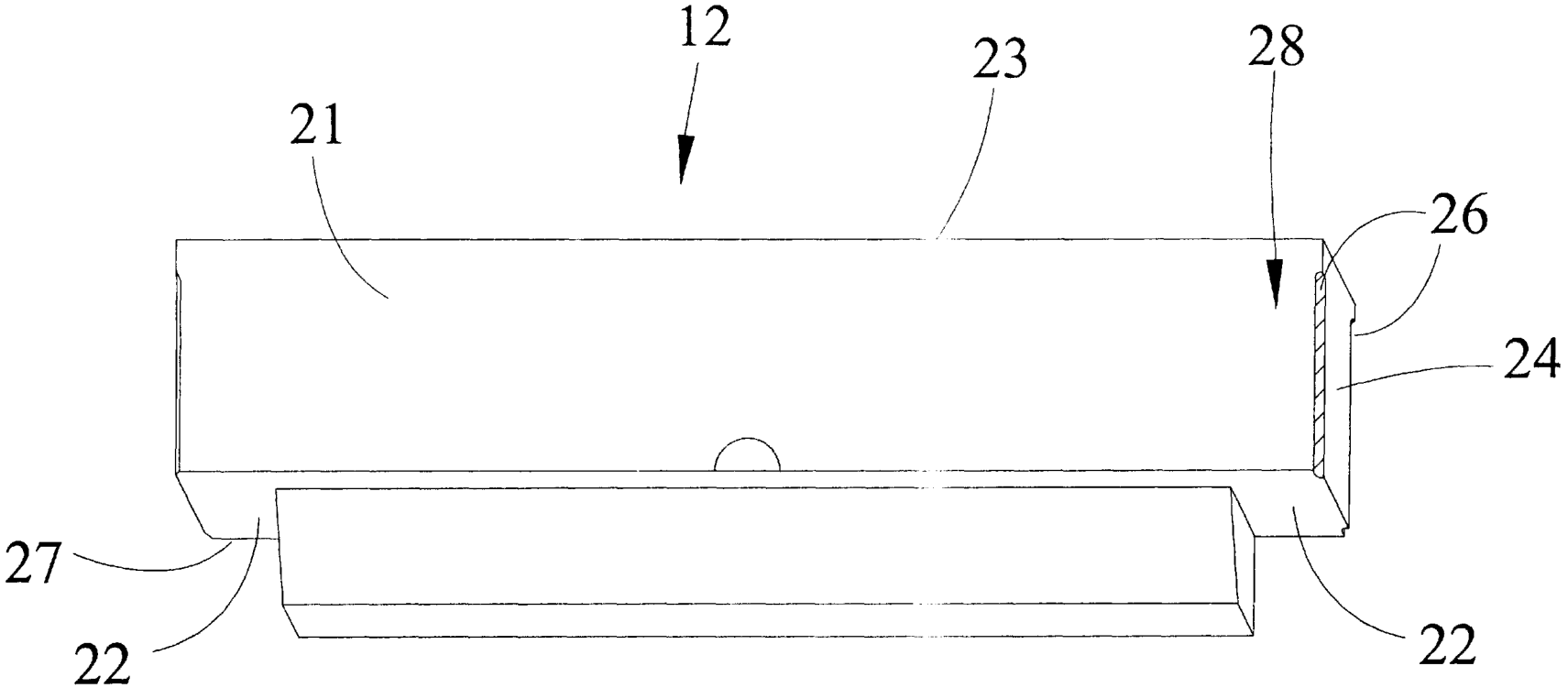
FIG. 2 is a perspective view of an the improved shutter rail of the present invention.
Figure 2A:
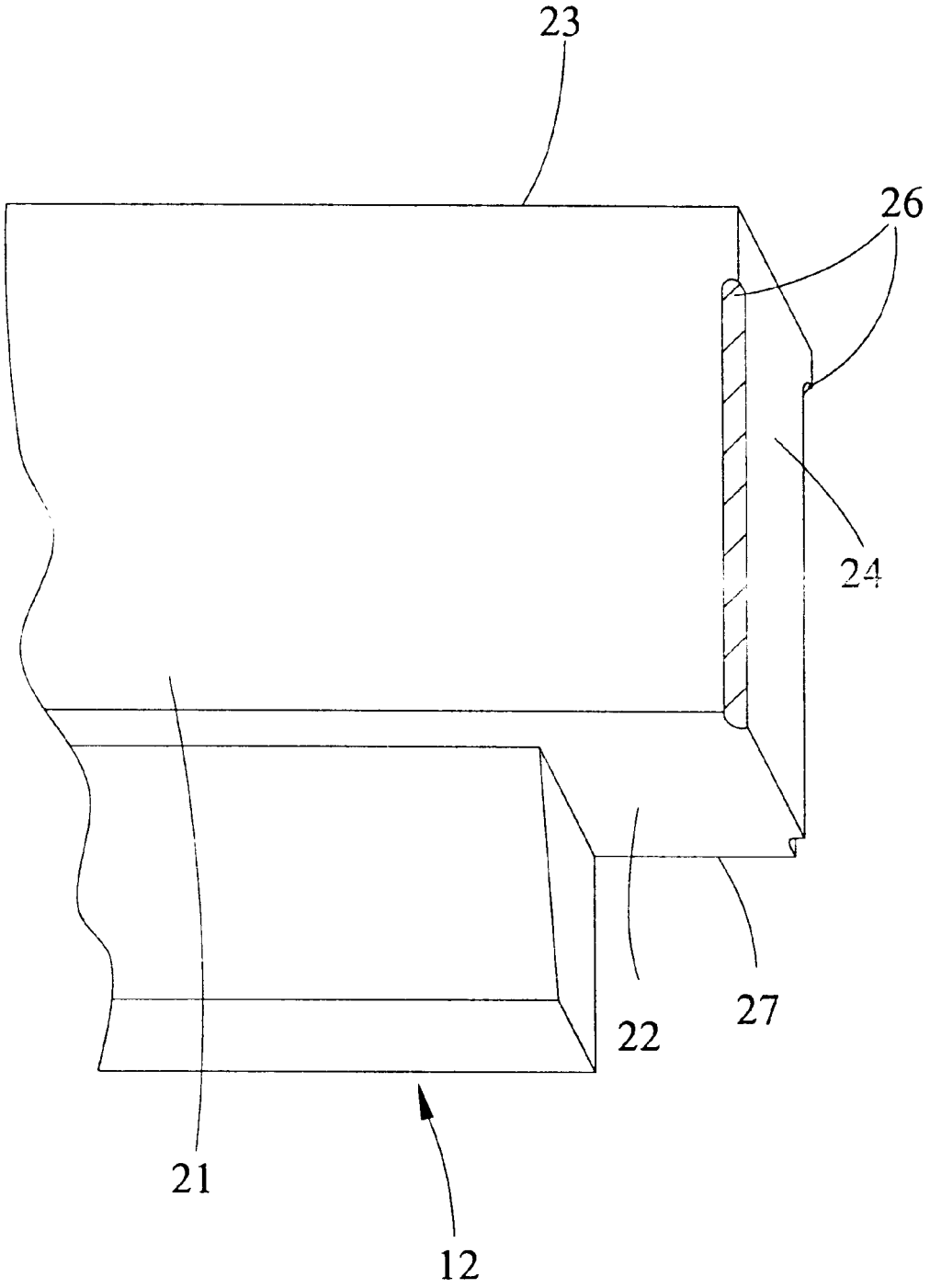
FIG. 2A is a perspective view of an end portion of the improved shutter rail of the present invention.
Figure 6:
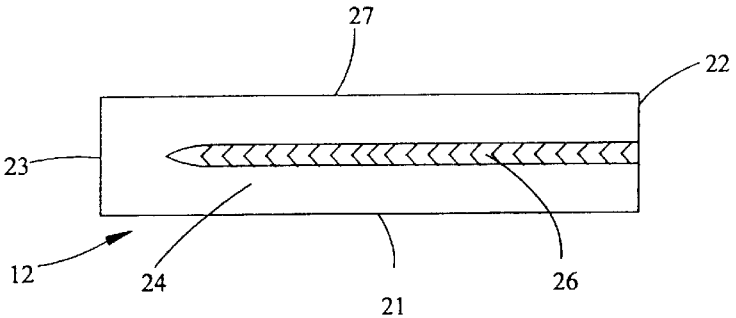
FIG. 6 is an end view of a rail depicting an alternative embodiment of the present invention with a single bonding agent weeping slot.
Figure 5:
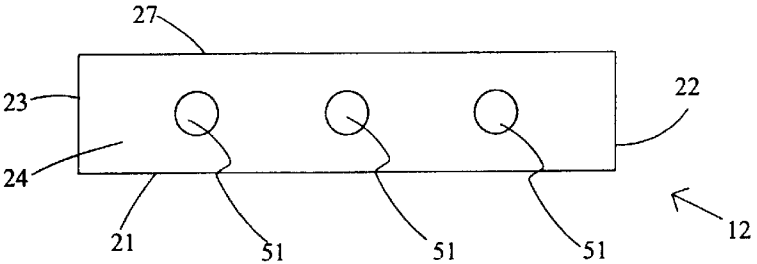
FIG. 5 is an end view of a rail depicting an alternative embodiment of the present invention with bonding agent weeping bores.

In FIGS. 2 and 6, it may be seen that shutter rail 12 has a front face 21, an inner face 22, an outer face 23, an end face 24 and a bonding agent weeping slot 26. Bonding agent weeping slot 26 extends outwardly from inner face 22 and terminates before reaching outer face 23. In the embodiment depicted in FIG. 2 and 2A, bonding agent weeping slot 26 also extends into end face 24. However, such a configuration is not necessary to practice the invention as numerous alternative weeping slot 26 configurations, each achieving similar results, will be readily recognized by those skilled in the art. Preferably, a second bonding agent weeping slot 26 is similarly formed along a back face 27 of rail 12 to improve the results obtained by the invention.

Figure 4:
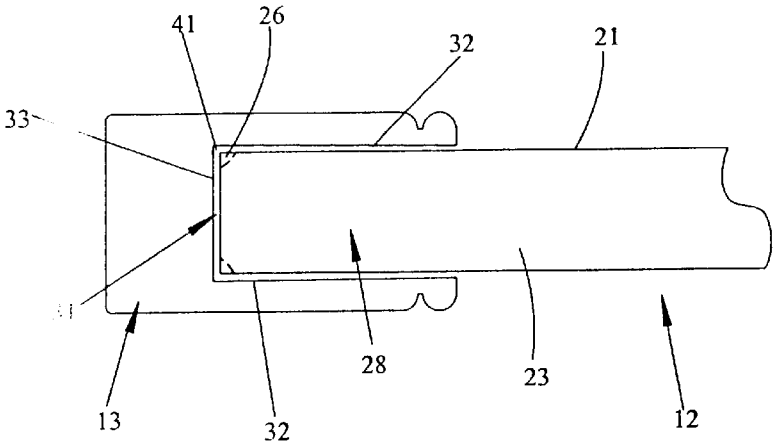
FIG. 4 is a sectional view of the rail and stile joint of the present invention.
Figure 3:
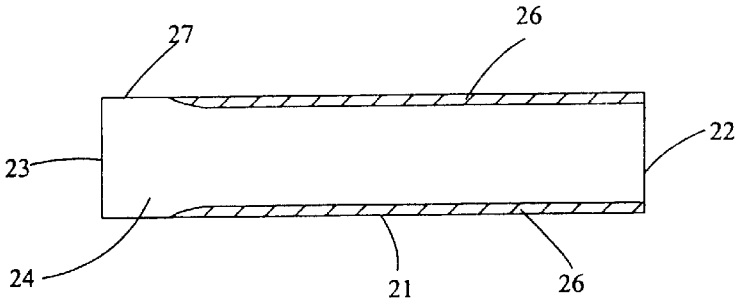
FIG. 3 is an end view of the improved shutter rail of the present invention.

As may be seen in FIG. 4, an end portion 28 of rail 12 is received within a channel section 31 formed in stile 13. Channel section 31 having inner faces comprised of two substantially parallel faces 32 and an interconnecting face 33 disposed between parallel faces 32. In the embodiment depicted, bonding agent weeping slots 26 and channel faces 32 and 33 define a pair of bonding agent weeping conduits 41. Whereas bonding agent weeping slots 26 do not extend to outer face 23 of rail 12, excess bonding agent is communicated inwardly within conduits 41 as rail 12 is pressed within stile channel section 31. As part of the curing process, bonding agent melds rail 12 with stile 13.

In many instances end portion 28 is inserted into channel section 31 perpendicular to a longitudinal length of stile 13. As a result, an alternative embodiment of the invention comprises at least one bonding agent weeping bore 51 formed along end face 24 having a sufficient depth to receive excess bonding agent therein, thereby preventing excess bonding agent from marring the exterior edges of the finished shutters.

It should be appreciated that the embodiments described herein may be combined or altered without departing from the essential characteristics or spirit of the invention described herein.

What I claim is:

1. An improved window shutter comprising a pair of opposed linearly extending rails and a pair of opposed linearly extending stiles, said rails and stiles defining a shutter frame retaining a plurality of parallel louvers pivotally disposed between and normal to said stiles, said rails received by a channel within said stiles and joined by a bonding agent therein, said rail having a substantially rectangular cross sectional shape, and further comprising opposed inner and outer faces extending along a thickness of said rail, opposed front and back faces extending along a width of said rail, and opposing end faces, said inner face oriented parallel and facing said louvers, said outer face oriented outwardly of said shutter frame, and at least one bonding agent weeping slot, said slot formed in each end face and extending from said inner face, said slot received within said channel to define a bonding agent weeping conduit, having an end open at said inner face.

2. The shutter of claim 1, further comprising at least one weeping slot extending along a front and a back face of said rail.

3. The shutter of claim 2, wherein at least one weeping slot formed on said front and back faces extends to an end face of said rail.

4. The shutter of claim 1 wherein at least one said weeping slot is formed at the junction of said front and back face with said end face.

5. The shutter of claim 1, wherein said rails and stiles are formed from extruded plastic.

6. The shutter of claim 1, wherein said bonding agent melds said rails with said stiles.

7. An improved shutter comprising a pair of opposing rails and a pair of opposing stiles, said rails received in said stiles and joined by a bonding agent therein, said rail comprising at least one bonding agent weeping slot, a. said slot extending from an inner face of said rail and terminating before reaching an outer face of said rail, b. said slot and at least one inner face of said stile defining a bonding agent weeping conduit.

8. The shutter of claim 7, wherein said slot is formed on a front face of said rail.

9. The shutter of claim 8, wherein said slot formed on said front face extends to an end face of said rail.

10. The shutter of claim 7 wherein said slot is formed on an end face of said rail.

11. The shutter of claim 7, wherein said rails and stiles are formed from extruded plastic.

12. The shutter of claim 11, wherein said bonding agent melds said rails with said stiles.

13. The shutter of claim 7, wherein said slot is formed on a back of said rail.

14. The shutter of claim 13, wherein said slot formed on said back face extends to an end face of said rail.

15. A shutter rail and stile joint comprising a stile having a channel with a plurality of inner faces formed therein, said channel receiving an end of a shutter rail for bonding said rail with a bonding agent therein, said rail comprising an inner face and an outer face, and at least one bonding agent weeping slot, c. said bonding agent weeping slot extending from said inner face and terminating before reaching said outer face, d. said bonding agent weeping slot and at least one inner face of said stile channel defining a bonding agent weeping conduit.

16. A shutter rail and stile joint comprising a stile having a channel with a plurality of inner faces formed therein, said channel receiving an end of a shutter rail for bonding said rail with a bonding agent therein, said rail comprising an end face, and at least one bonding agent weeping bore extending normal said end face, said bore receiving said bonding agent therein as said stile and rail are pressed into a finished orientation relative each other.

* * * * *